US005123776A

United States Patent [19]

Lang et al.

[11] Patent Number: 5,123,776

[45] Date of Patent: Jun. 23, 1992

[54] PLASTIC FILLABLE MANHOLE COVER WITH PENETRATING HANDLES

[75] Inventors: Timothy J. Lang, Washougal, Wash.; Mark Stuhlreyer, Columbus, Ohio; Eli Blumenau, K. Tivon, Israel

[73] Assignee: Advanced Drainage Systems, Inc., Columbus, Ohio

[21] Appl. No.: 648,077

[22] Filed: Jan. 31, 1991

[51] Int. Cl.[5] ..... E02D 29/14

[52] U.S. Cl. ..... 404/25

[58] Field of Search ..... 404/25, 26

[56] References Cited

U.S. PATENT DOCUMENTS

| | | | |
|---|---|---|---|
| 1,014,138 | 1/1912 | Ford | 404/25 |
| 1,673,145 | 6/1926 | Gschwind | 404/26 |
| 2,356,750 | 8/1942 | Walker | 404/25 |
| 4,123,184 | 10/1978 | Whitlock | 404/25 |
| 4,762,440 | 8/1988 | Argandona | 404/25 |
| 4,861,186 | 8/1989 | Fern | 404/25 |
| 4,974,992 | 12/1990 | Harter | 404/25 |

FOREIGN PATENT DOCUMENTS

| | | | |
|---|---|---|---|
| 2145444 | 3/1985 | United Kingdom | 404/26 |

*Primary Examiner*—Ramon S. Britts
*Assistant Examiner*—N. Connolly
*Attorney, Agent, or Firm*—Biebel & French

[57] ABSTRACT

A manhole cover comprises a top having a top surface and an edge portion, a depending portion having a sidewall and a bottom surface, and an interior chamber. The manhole cover is fabricated from a first material, while the interior chamber is at least partially filled with a second material. The manhole cover preferably includes recessed handles which are recessed into the top and extend downwardly through the bottom surface. Cooperative engagement means in the form of inter-fitting indentations and protuberances are provided in the top surface and the bottom surface respectively. The bottom surface includes a first surface portion which includes a peripheral edge portion and a bracing portion. The bracing portion includes a plurality of brace members each of which have a lower brace surface and a brace sidewall.

11 Claims, 3 Drawing Sheets

PLASTIC FILLABLE MANHOLE COVER WITH PENETRATING HANDLES

BACKGROUND OF THE INVENTION

This invention is directed to the providing of a manhole cover, and more specifically, to a plastic manhole cover.

Traditionally manholes provided a means for accessing a city's sewer system. The brick or concrete manhole was provided with a relatively heavy metal grate or cover. As time passed, the manholes themselves were able to be prefabricated in one piece from concrete, and placed into the ground where needed usually by means of a crane, since concrete manholes weigh well over 1000 pounds. Concrete manholes still are in use today as the preferred type of manhole.

Traditionally, manholes were located in thoroughfares, and more recently in curbside locations between a street and a sidewalk. The rationale for eliminating the presence of manholes in streets has to do with the problems associated with road repair and resurfacing.

With the advent of increased usage of cable television systems and below ground positioning of electric and telephone wires, it has been found that manholes provide an excellent means to access and repair such systems, regardless of whether the manhole is connected to or a part of, the sewer system. Due to the potential presence of manholes away from the flow of traffic, manholes which service cable systems in particular, are often located in secluded greenspace. However, many of these locations are in residential areas where small children live. Children, often have an attraction to closed manholes. Traditional metallic manhole covers while weighing approximately XXX pounds are primarily disk-shaped and prone to dislodgment by the sudden placing of a large amount of weight along a peripheral edge, or by the prying of curious children. A manhole, once opened, can become a dangerous trap for the unwary. Furthermore, the traditional metal covers are not aesthetically appealing when installed, especially in greenspace, and typically become less appealing with age.

Therefore the need exists for a manhole cover which is not easily subject to dislodgment from atop a manhole, and which is aesthetically pleasing.

SUMMARY OF THE INVENTION

A manhole cover which is not easily dislodged, while at the same time being aesthetically pleasing is provided by this invention. There is provided a manhole cover for use with a manhole, with the manhole cover comprising a top and a depending portion. The top includes a top surface and an edge portion while the depending portion includes a sidewall and bottom surface, with the bottom surface being spaced more than one fixed distance from the top. The bottom surface includes a first surface portion which is parallel to the top surface. The bottom surface also includes a second surface portion having a sloped surface.

The manhole cover also includes handles, preferably recessed into the top and extending through the bottom surface. The manhole cover is fabricated from a first material and includes an interior chamber which is at least partially filled with a second material. Preferably the second material includes cement.

The top surface and bottom surface include cooperative engagement means in the form of indentations in the top surface and protuberances on the bottom surface.

The first surface portion includes a peripheral edge portion and a bracing portion. The bracing portion includes a plurality of braced members each of which has a lower brace surface and a brace sidewall. The brace sidewall preferably has a sloped surface.

There is also disclosed an invention in a manhole cover with the manhole cover fabricated from a first material comprising a top, a depending portion and an interior chamber. The top includes a top surface and edge portion. The depending portion includes a sidewall and a bottom surface with the bottom surface having a first surface portion and a second surface portion, and the interior chamber being at least partially filled with a second material.

A primary object of this invention is to provide a manhole cover which, while being difficult for a child to dislodge due to the weight of the cover, is nevertheless made easy for removal by an adult without the aid of tools such as a pry bar.

Still another object of the invention is to provide an aesthetically pleasing manhole cover for use with manholes located in greenspace.

Still another object of the invention is to provide a manhole cover which is relatively simple to fabricate and install in operative relationship to a manhole, yet which is extremely effective in resisting dislodgment.

Other objects and advantages of the invention will be apparent from the following description, the accompanying drawings and the appended claims.

DETAILED DESCRIPTION OF THE PREFERRED EMBODIMENT

Figure 1:
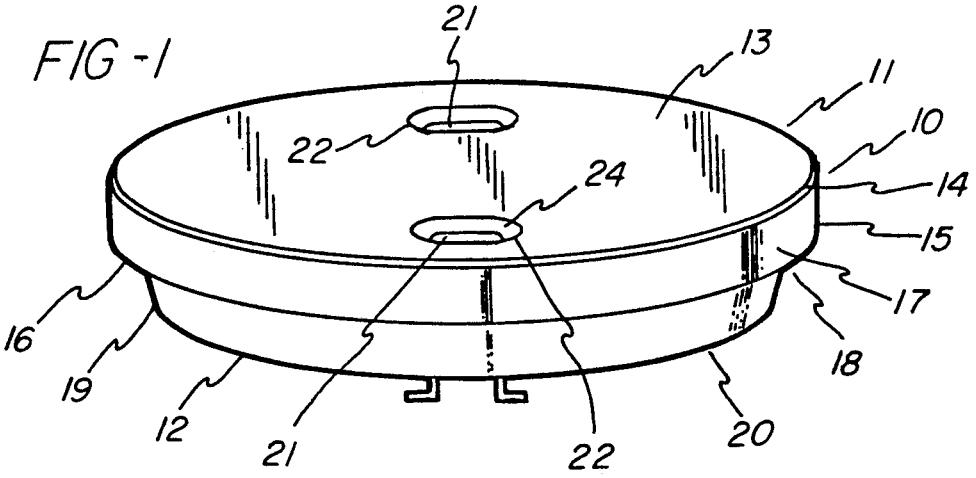
FIG. 1 discloses a perspective view of the manhole cover made in accordance with this invention.

Having reference to the drawing figures, attention is first directed to FIG. 1 which discloses a manhole cover made in accordance with this invention and designated generally by the numeral 10. The manhole cover 10 of this invention comprises a top 11 and a depending member 12. The top 11 has a top surface 13, a rounded peripheral edge 14 and a flanged lip 15. The flanged lip 15 includes a lip base 16, a lip outer surface 17, and lip inner surface 18. The depending member 12 features sidewall 19 and bottom surface 20.

Figure 2:
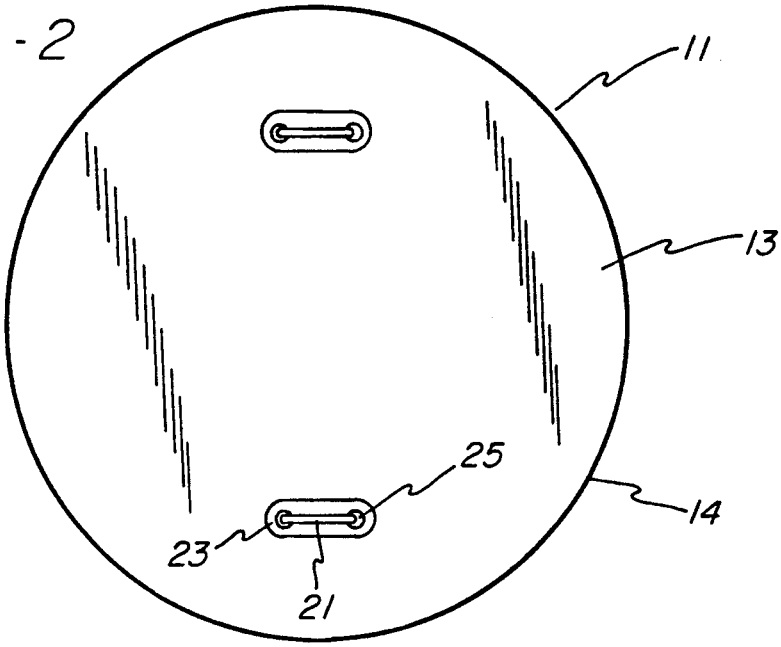
FIG. 2 discloses a top planned view of the manhole cover of this invention.
Figure 3:
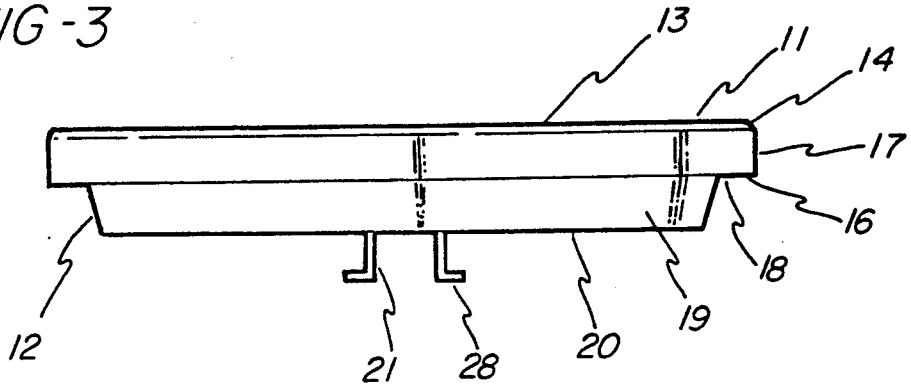
FIG. 3 discloses a side elevational view of the manhole cover seen in FIG. 1.
Figure 4:
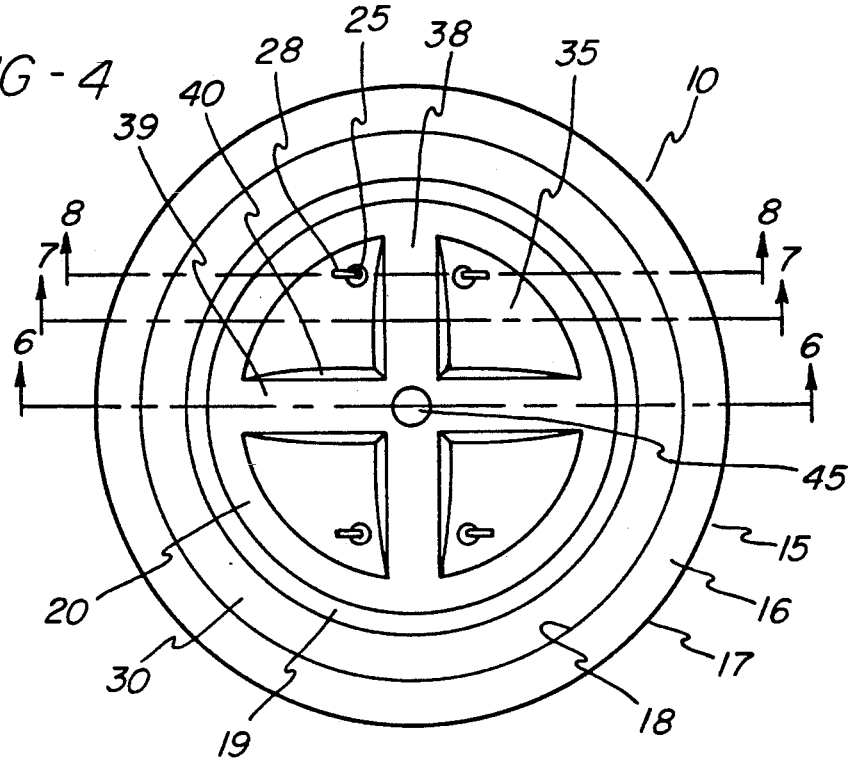
FIG. 4 discloses a bottom plan view of the invention.
Figure 6:
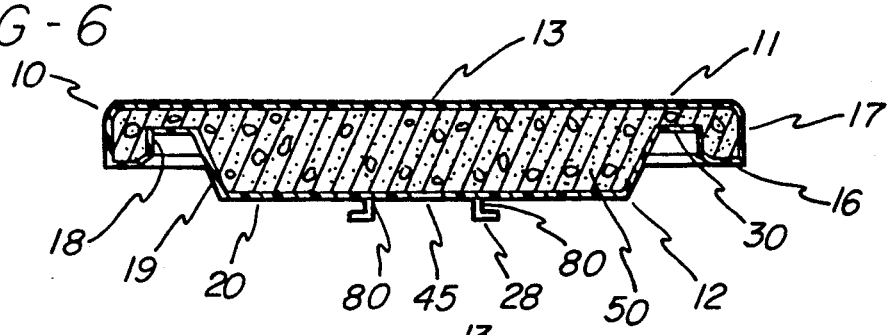
FIG. 6 is a vertical sectional view taken along line 6—6 of FIG. 4.
Figure 7:
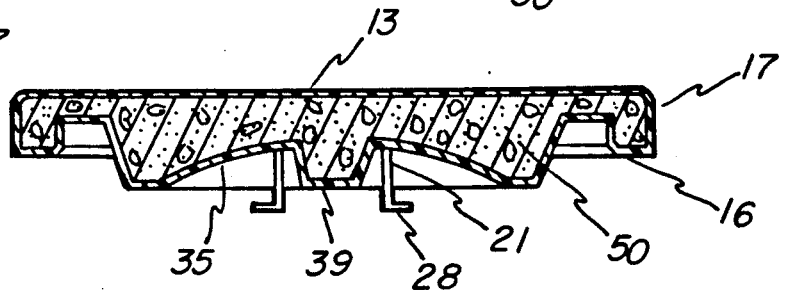
FIG. 7 is a vertical sectional view taken along line 7—7 of FIG. 4.

As can be better seen in FIGS. 2 and 3, the manhole cover 10 includes handles 21 which are located in recessed portions 22 of top 11. Each handle has associated therewith a recessed portion 22 having a base 23, a recessed sidewall 24 and a handle aperture 25. The handle aperture extends completely through the manhole cover, thus permitting a portion of the handle to pass through the cover and depend downwardly therefrom. At the bottom of the handles 21 are handle retention means 29.

In the preferred embodiment of the invention, the handles are formed from a steel rod which is ⅜" in diameter. The uppermost portion of the handle lies parallel to the top surface 13, as well as to base 23. Preferably top surface 13 is relatively planar. The upright portions of the handle also depend essentially perpendicularly from the top of the handle, while the handle retention means 28 are shown as outwardly turned portions of the rod. In the alternative they may be welded portions of steel rods, approximately ⅜" in diameter, which prevent the withdrawal of the handle 21 from manhole cover 10. The diameter of the handle aperture 25 is approximately ½".

As can be seen in FIGS. 4 through 8, the manhole cover 10 has a top 11 containing a lower lid surface 30. Preferably lower lid surface 30 is parallel to top surface 13 and located a distance of approximately 2" from the top surface. In the preferred embodiment the lower lid surface 30 also has a width of approximately 2". The lower lid surface 30, when the manhole cover 10 is installed in operative embodiment on a manhole, abuts the upper neck portion of a manhole. Flanged lip 15 has its lip inner surface 18 extending approximately 1"downward from the lower lid surface 30.

The bottom surface 20 of the depending member 12 comprises concave portions 35 and brace members 38. The various concave portions 35 cooperate to form a concave surface in the depending member 12, which surface is interrupted by the presence of brace members 38. Each brace member 38 includes lower brace surface 39 which preferably is parallel to the top surface 13, and a sloped brace sidewall 40 which extends between lower brace surface 39 and concave portions 35.

The manhole cover 10 of this invention is formed with an inlet port 45 through which a material, preferably other than that used to form the top and depending member, can be introduced into the interior chamber 48 of the manhole 25 cover. Preferably the top 11 and depending member 12 of this invention are formed from a plastic material such as polyethylene. While numerous materials could be introduced into, and at least partially fill, interior chamber 48, it has been found that one material which is excellent for this purpose is one which comprises cement. Cement may be easily introduced into the outlet port, uniformly distributes weight within the interior chamber 48, and results in the providing of a manhole cover 10, which when filled with a dense second material such as cement 50, can weigh over 200 pounds, so as to preclude the accidental dislodgment of the manhole cover 10 from atop the manhole as well as the removal of the cover by younger children.

Figure 8:
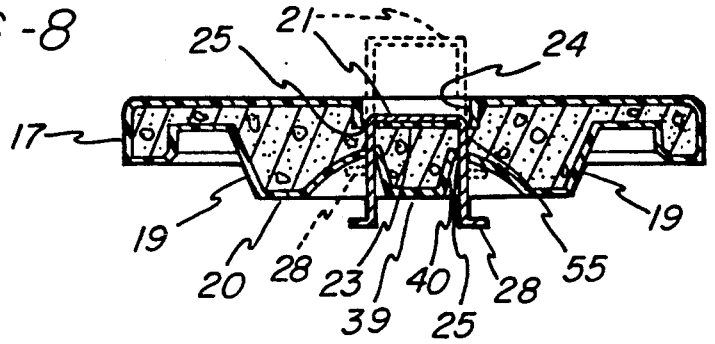
FIG. 8 is a vertical sectional view taken along line 8—8 of FIG. 4.
Figure 5:
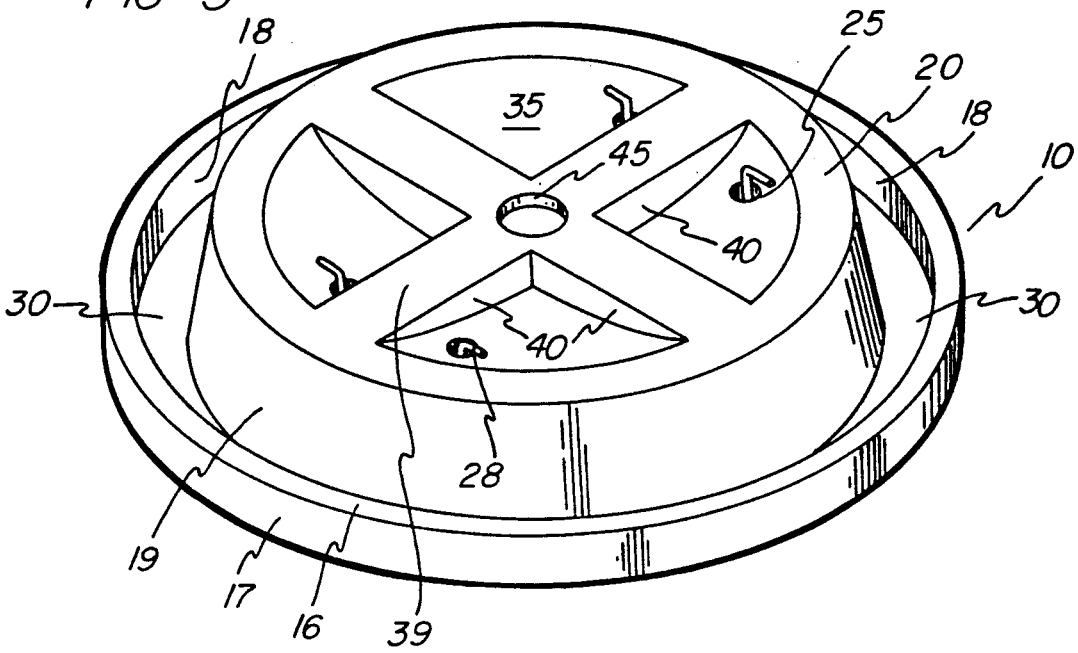
FIG. 5 is a perspective view of the bottom of the manhole cover of this invention.

As can be best seen in FIG. 8, handles 21 extend through a handle conduit 55, preferably formed through the second material 50. One way of forming handle conduits 55 is by the insertion of ½" diameter greased bars through the second material while it has not yet solidified. After the second material has solidified, the rod with its coating of grease or other suitable petrochemical, may be withdrawn from the second material leaving behind handle conduit 55. Once the handle 21 is inserted through handle conduit 55 and handle retention means 28 is in place, whether the handle retention means are formed from rods as shown or for example consist of a nut or other fastening means whose diameter is 25 greater than that of the handle conduit 55, the handle 21 may move freely up and down through handle conduit 55, such that when the manhole cover is in its operative position the upper portion of the handle is resting in a recessed position within recessed portion 22.

When it is necessary to remove the manhole cover, so that access by an adult may be gained to the manhole, an adult need merely grasp handle 21 and pull upwardly thereon. The handle retention means 28 will soon abut against concave portion 35 of the bottom surface 20 of depending member 12, thereby permitting further lifting on the handle to result in the removal of the manhole cover 10 from atop its manhole. Similarly in replacing the manhole cover 10 of this invention atop a manhole, one need merely lift up on the handles 21, position the lower lift surface 30 above the upper neck portion of the manhole, and lower the manhole cover into place. The handles may then be released, at which time their tops will descend into recessed portion 22. The lower portion of the handles and the handle retention means 28 thereafter hang within the enclosed manhole cavity.

Figure 9:
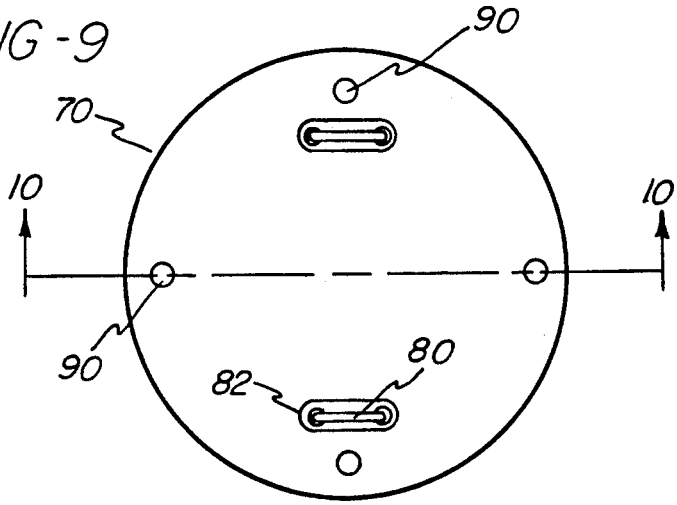
FIG. 9 is a top plan view of a modified embodiment of the manhole cover of this invention.
Figure 10:
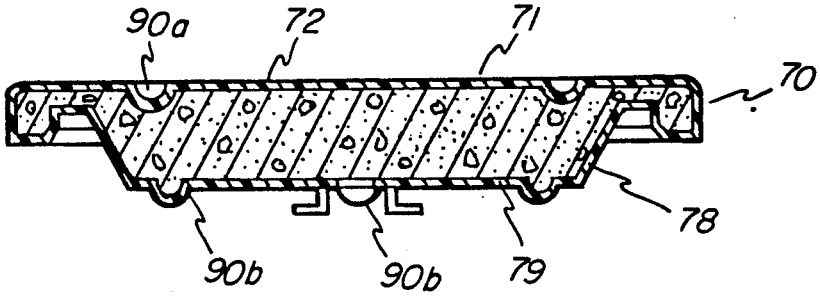
FIG. 10 is a vertical sectional view taken along line 10—10 of FIG. 9.

FIGS. 9 and 10 show a slightly modified embodiment of the invention with a cover 70, with top 71 comprising top surface 72, and a depending member comprising sidewall 78 and bottom surface 79. Preferably the modified cover also includes handles 80 which are positioned in recessed portions 82. As shown in FIG. 9, a plurality of cooperative engagement means 90 are provided. The cooperative engagement, means as can be better seen in FIG. 10, include indentations 90 (a) and protuberances 90 (b) which mechanically inter-fit with one another to assist in stabilizing the manhole covers when they are stacked for purposes of storage, prior to actual installation in cooperation with a manhole. It will be appreciated that the cooperative engagement means 90 are preferably associated with brace members 38. For example, in FIGS. 9 and 10, each of the brace members are associated with a pair of cooperative engagement means 90.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A manhole cover for use with a manhole, said manhole cover comprising a top planar portion, an outer sidewall having an outwardly facing exterior surface depending downwardly from the periphery of said top planar portion, a centrally disposed depending portion located inwardly of said outer sidewall, said centrally disposed depending portion having a sidewall and a bottom surface, said bottom surface having a first section being approximately parallel to said top planar portion, said bottom surface also having a second section disposed inwardly of said depending portion sidewall, said second section sloped relative to said top planar portion and said first section, and an interior chamber located below said top planar portion and above said centrally disposed depending portion, said manhole cover fabricated from a first material and said interior chamber at least partially filled with a second material.

2. The manhole cover as claimed in claim 1 wherein said manhole cover includes handles.

3. The manhole cover as claimed in claim 2 wherein said handles are recessed.

4. The manhole cover as claimed in claim 3 wherein said handles are recessed into said top planar portion, and extend through said bottom surface.

5. The manhole cover as claimed in claim 1 wherein said top surface and said bottom surface both include cooperative engagement means, said top surface engagement means on the manhole cover cooperating with the bottom surface engagement means of an adjacent manhole cover, and said bottom surface engagement means of the manhole cover cooperating with the top surface means of another adjacent manhole cover.

6. The manhole cover as claimed in claim 5 wherein said cooperative engagement means comprise indentations in said top planar portion and protuberances on said bottom surface.

7. The manhole cover as claimed in claim 1 wherein said first section of bottom surface includes a plurality of brace members, each of said brace members having a lower brace surface and a brace sidewall.

8. The manhole cover as claimed in claim 7 wherein said brace sidewall has a sloped surface.

9. The manhole cover as claimed in claim 8 wherein said second material includes cement.

10. The manhole cover as claimed in claim 1 wherein said bottom surface has an aperture formed therein for the introduction of said second material into said interior chamber.

11. The manhole cover as claimed in claim 10 wherein said aperture for the introduction of said second material into said interior chamber is formed in said first surface of said bottom surface.

* * * * *